US008307675B2

(12) United States Patent
Avganim

(10) Patent No.: US 8,307,675 B2
(45) Date of Patent: Nov. 13, 2012

(54) COMPUTER CASING LOCK

(76) Inventor: Meir Avganim, M.P. Nachal Sorek (IL)

( * ) Notice: Subject to any disclaimer, the term of this patent is extended or adjusted under 35 U.S.C. 154(b) by 0 days.

(21) Appl. No.: 13/132,887

(22) PCT Filed: Dec. 10, 2009

(86) PCT No.: PCT/IL2009/001170

§ 371 (c)(1),
(2), (4) Date: Aug. 12, 2011

(87) PCT Pub. No.: WO2010/070635

PCT Pub. Date: Jun. 24, 2010

(65) Prior Publication Data

US 2011/0283752 A1 Nov. 24, 2011

(30) Foreign Application Priority Data

Dec. 15, 2008 (IL) ..... 195952

(51) Int. Cl.
*E05B 67/36* (2006.01)

(52) U.S. Cl. ..... 70/2; 70/6; 70/14; 70/32; 70/164; 70/232; 70/DIG. 57

(58) Field of Classification Search ..... 70/14, 58, 70/2, 6–13, 32–34, 54–56, 164, 232, DIG. 57; 292/149

See application file for complete search history.

(56) References Cited

U.S. PATENT DOCUMENTS

| | | | | |
|---|---|---|---|---|
| 3,599,453 | A | 8/1971 | Bauernfeind | |
| 6,075,693 | A | 6/2000 | Leman | |
| 7,562,547 | B2 * | 7/2009 | Avganim | 70/58 |
| 2005/0204786 | A1 | 9/2005 | Meyer et al. | |
| 2007/0119219 | A1 * | 5/2007 | DeMartinis et al. | 70/58 |
| 2007/0157680 | A1 | 7/2007 | DeMartinis et al. | |
| 2007/0193314 | A1 * | 8/2007 | Avganim | 70/58 |
| 2008/0264116 | A1 | 10/2008 | McNeil | |

FOREIGN PATENT DOCUMENTS

| | | |
|---|---|---|
| CA | 2 293 754 A1 | 6/2001 |
| DE | 2 414 377 | 11/1974 |
| WO | WO 00/45017 | 8/2000 |

* cited by examiner

*Primary Examiner* — Lloyd Gall
(74) *Attorney, Agent, or Firm* — Ostrolenk Faber LLP

(57) ABSTRACT

A locking device for box-shaped containers (20) having a base and a separable cover each provided with an ear-like extension (20*c*; 20*d*) with openings, wherein in the lockable position the openings are in register one with respect to the other. The device comprises a block-shaped housing (10) with a key-operated mechanism (30) comprising a rotor. A slidable locking element is coupled to the rotor so that upon rotation of the rotor by 180° in one or the opposite directions by turning the key, a locking element slides over a certain distance in one or the opposite directions. A cavity is formed in the housing configured to accommodate therein both ear-like extensions (20*c*; 20*d*). For locking the container, the locking element is driven in the direction of and across the cavity and openings.

5 Claims, 6 Drawing Sheets

COMPUTER CASING LOCK

This is a non-provisional application claiming the benefit of International Application Number PCT/IL2009/001170 filed Dec. 10, 2009.

FIELD OF THE INVENTION

The present invention generally relates to locking devices, and in particular to locks for desktop computer casings.

BACKGROUND OF THE INVENTION

Astonishing as it may seem to be in our modern, Hi-Tech era, is the fact that simple padlocks, one of the oldest human inventions, are still being used to lock many types of table computer casings.

Hence, referring to FIG. 1, there is shown a pair of projecting ears 1 and 2, forming part or otherwise affixed to computer casing or any other container such as a tool-box cover 3 and back wall 4, respectively. Aligned openings are formed in the ears 1 and 2 to receive therethrough yoke 5 of padlock body 6 operable by key 7 of a cylinder type locking mechanism.

It is therefore the general object of the present invention to devise a more safe, sophisticated, and user-friendly locking device for the purpose in question.

SUMMARY OF THE INVENTION

According to the invention there is provided a locking device for box-shaped containers having a base and a separable cover each provided with an ear-like extension having an opening, wherein in the lockable position the openings are in register one with respect to the other and the container becomes locked by insertion of a locking element through both openings, the device comprising; a block-shaped housing; a key-operated rotor installed within the housing; a slidable locking element coupled to the rotor so that upon rotation of the rotor by 180° in one or the opposite directions by turning the key, the locking element slides over a certain distance in one or the opposite direction extending normally to the axial direction of the rotor; and a cavity formed in the housing configured to accommodate therein both said ear-like extensions when in overlapping position, the arrangement being such that for locking the container, the locking element is driven in the direction of and across said cavity and openings, and for unlocking, the locking element is driven in the opposite direction out of the said cavity.

BRIEF DESCRIPTION OF THE DRAWINGS

These and additional features and advantages of the invention will become more clearly understood in the light of the following description of a preferred embodiment thereof, given by way of example only, with reference to the attached drawings, wherein—

DETAILED DESCRIPTION OF THE PREFERRED EMBODIMENTS

Figure 1:
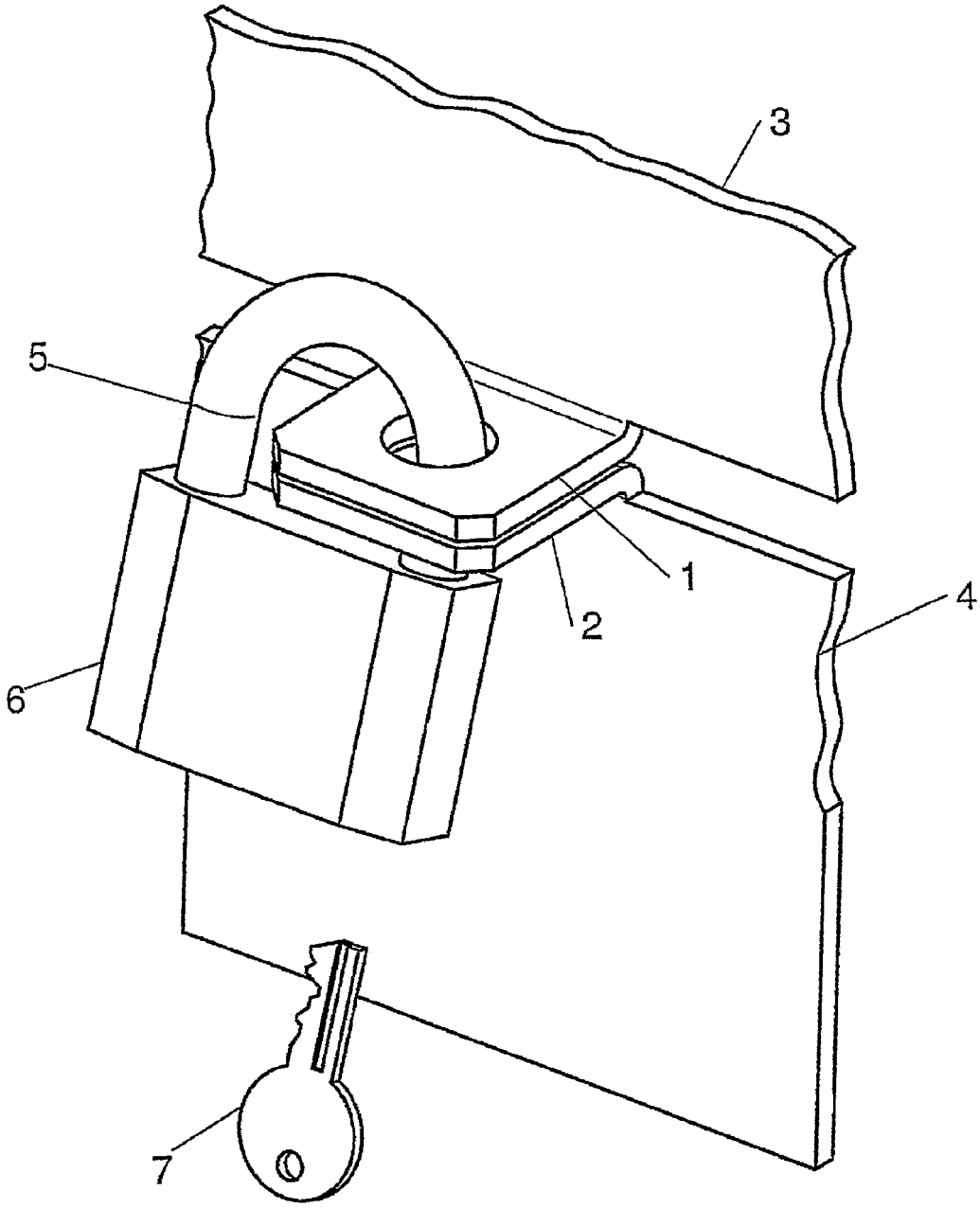
FIG.1 PRIOR ART
FIG. 1 is a perspective view of a conventional padlock arrangement.
Figure 2:
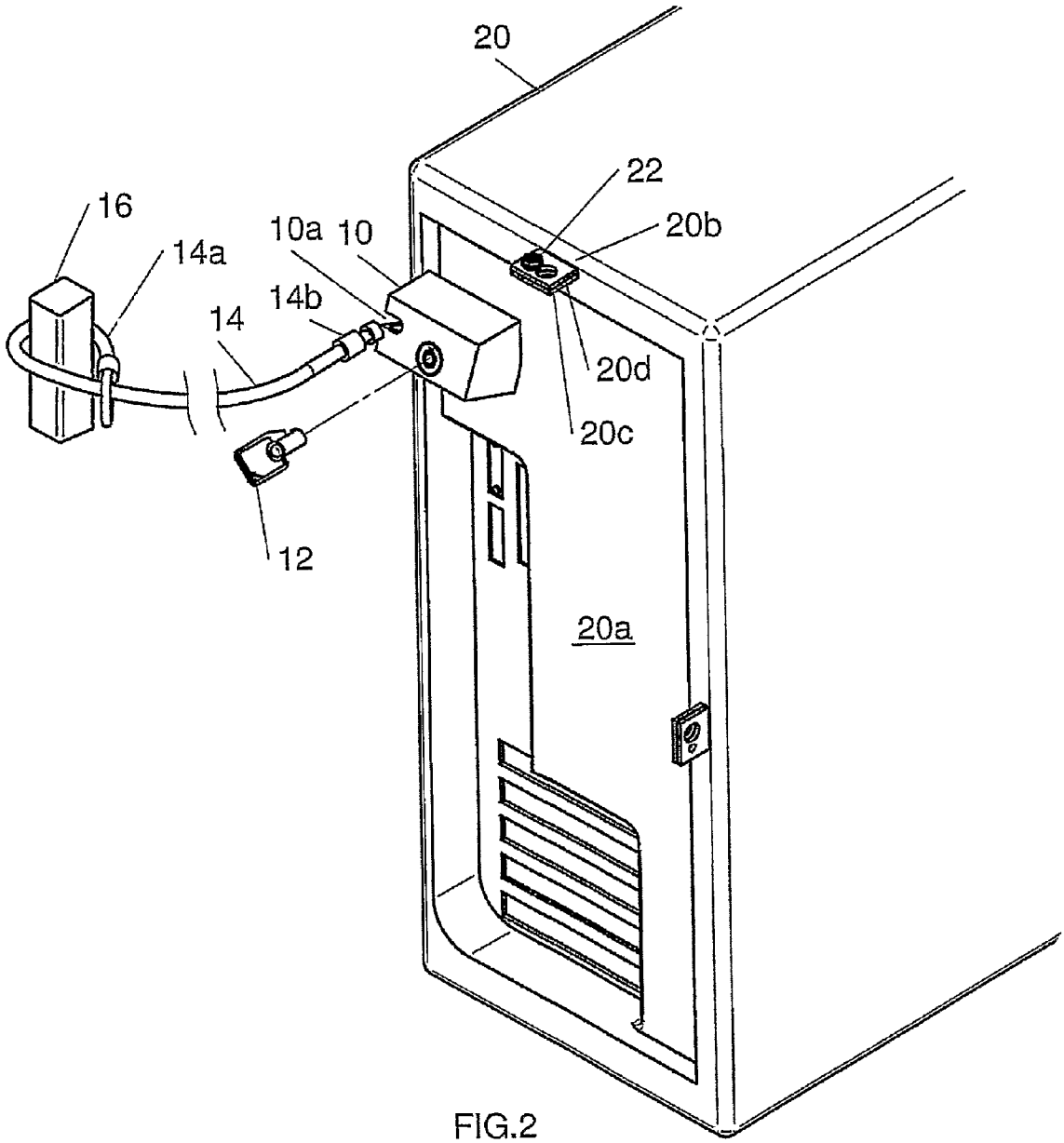
FIG. 2 is a general, schematic perspective view of a locking arrangement according to a preferred embodiment of the present invention.

In FIG. 2, 10 denotes the novel lock-body, which is operable by key 12.

Figure 5A:
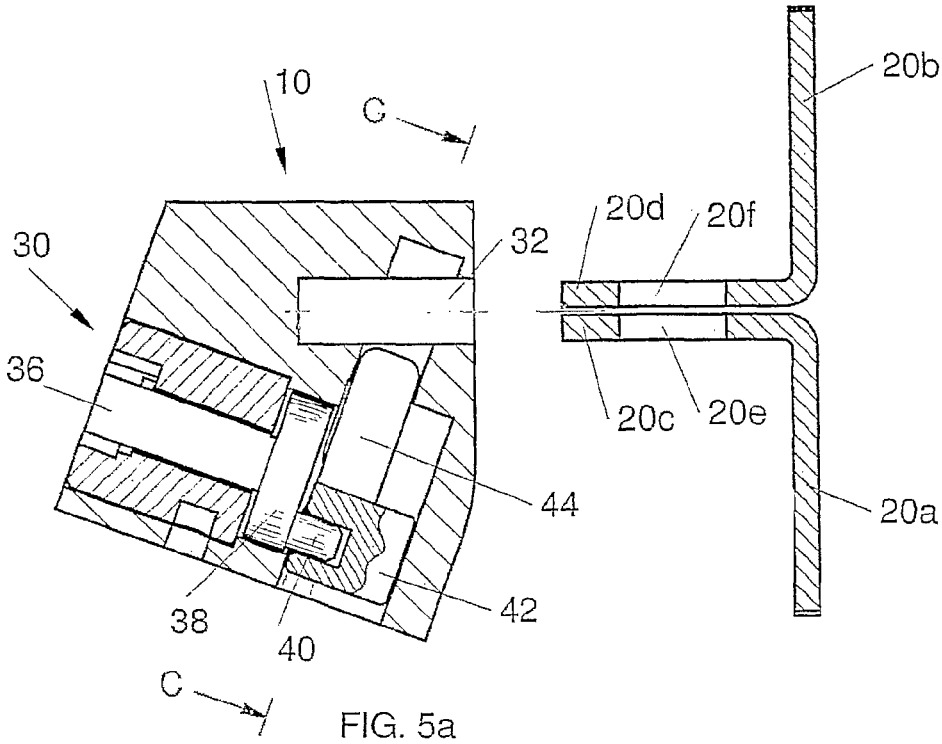
FIG. 5*a* is a sectional view taken along plane B-B of FIG. 3 in the unlocked position.
Figure 5B:
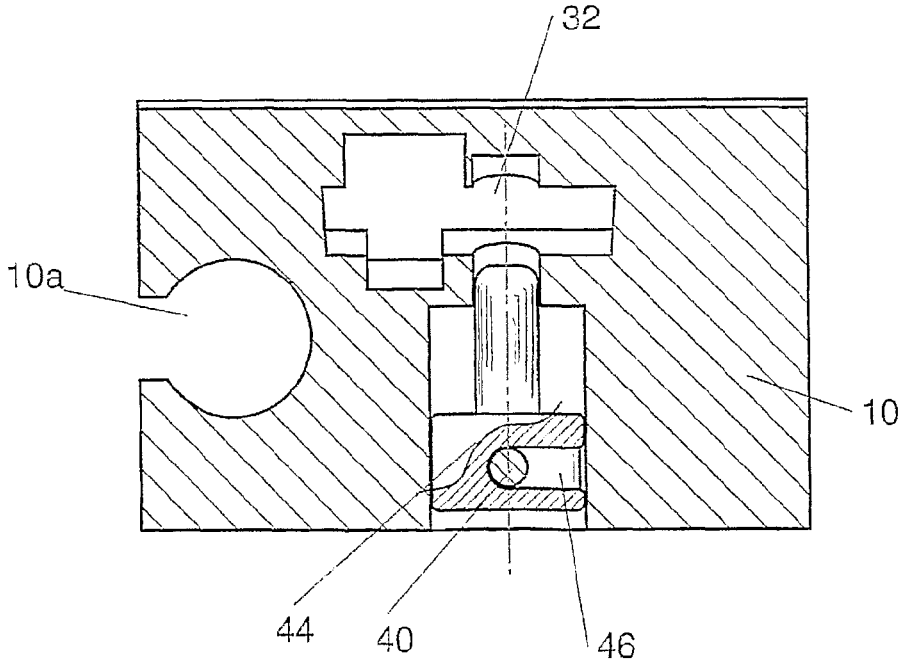
FIG. 5*b* is a sectional view taken along plane C-C of FIG. 5*a*.
Figure 5C:
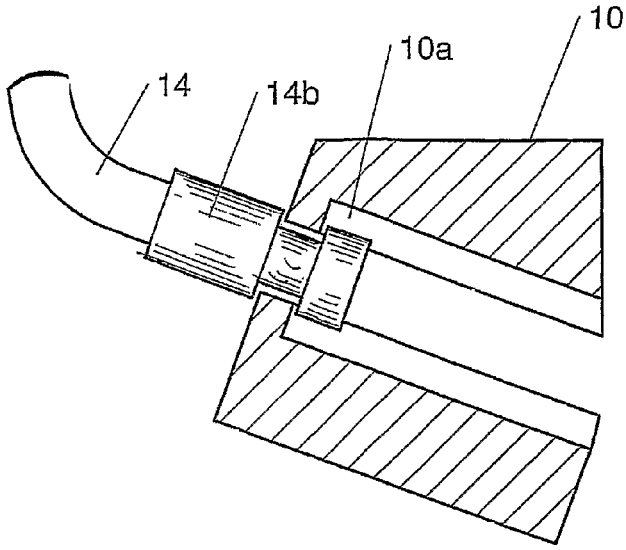
FIG. 5*c* is a view taken along plane D-D of FIG. 3.

A security cable 14 is provided and used in the conventional manner, namely looped at one end 14*a* to a fixed object 16 and the other end adapted to be arrested to the lock body 10 by cable-head 14*b* fitting into groove 10*a* when the latter is locked against computer casing generally denoted 20 (see FIG. 5*c*).

Figure 3:
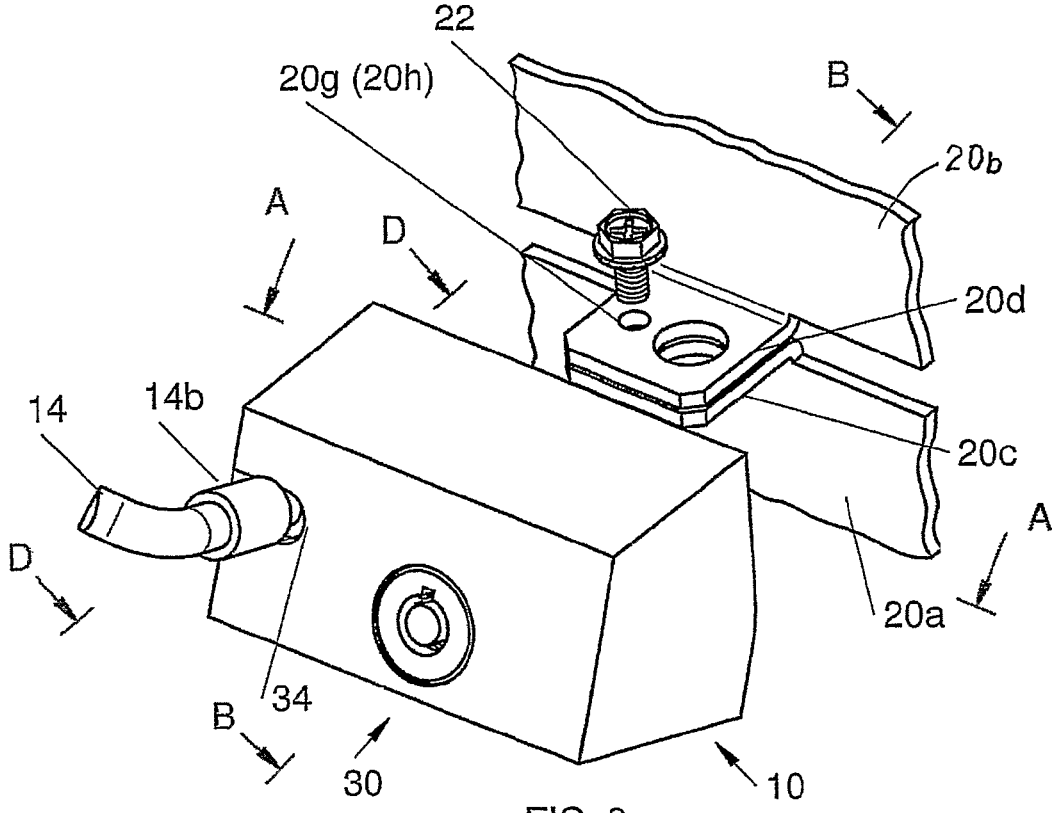
FIG. 3 is an enlarged view of the locking arrangement of FIG. 2.

As better seen in FIG. 3 the desktop computer casing 20 has a hinged or otherwise removable cover portion 20*a* and a main portion 20*b*, each provided with ears 20*c* and 20*d* formed with an opening 20*e* and 20*f*, respectively (see FIG. 5*a*).

Optionally, there are formed in the ears 20*c* and 20*d* a pair of additional aligned bores 20*g* and 20*h* for the passage of bolt 22 therethrough (see below).

Figure 4:
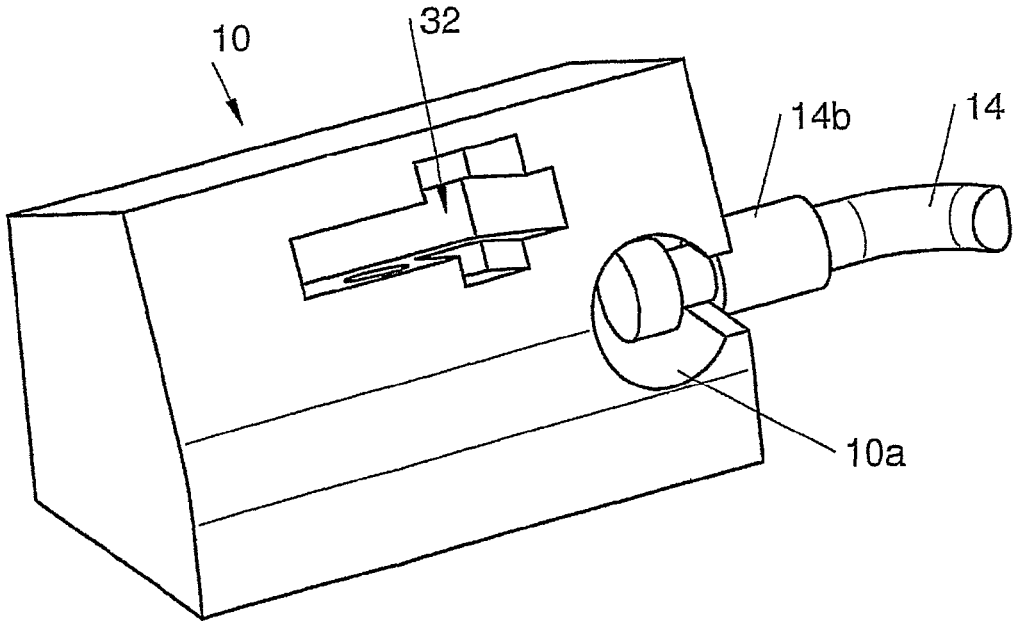
FIG. 4 is a view taken in the direction A-A of FIG. 3.

Turning now to the lock-body 10 as more clearly seen in FIGS. 4, 5*a* and 5*b*, there is provided a lock mechanism 30 of any conventional type which includes a rotor rotatable by the key 12 between locked and unlocked positions when turned 180°.

The lock-body is further formed with a cavity or recess 32 configured to receive both ears 20*c* and 30*d*, as well as the bolt 22 after being passed through the bores 20*g* and 20*h*.

The slot 10*a* which is formed at a side-wall of the lock-body 10 us adapted to secure thereinside the head 14*b* of the cable 14 before mounting and arresting the locking device, as will be explained below.

As shown in FIGS. 5*a* and 5*b*, rotor 36 of the locking mechanism 30 carries a disc 38, provided with an accenter to toggle pin 40. The pin 40 is coupled to a reciprocable block 42 carrying a lock pin 44. The toggle pin 40 is coupled to the block 42 via guide slot 46 enabling the rotation of the toggle pin 40 to lift and lower the block 42.

The first locking stage comprises the insertion of the cable-head 14*b* into and along the groove 10*a* as seen in FIG. 4, into the position shown in FIG. 3, after the other end of the cable 14 has been looped around a fixed object such as the table leg 16.

Figure 6:
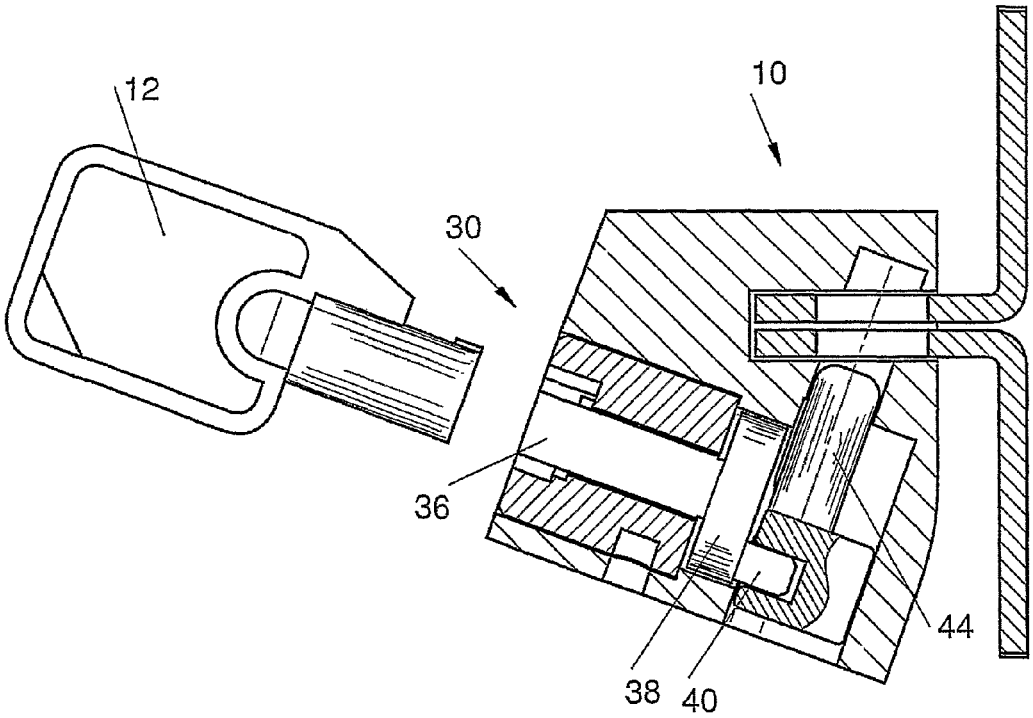
FIG. 6 depicts a first stage of locking the computer casing.

The next stage of arresting the lock-body to the computer casing is depicted in FIG. 6, namely by abutting the lock-body against the lock wall 20*a* of the computer so that the ears 20*c* and 20*d*, optionally along with the bolt 22 (FIG. 3) passed through the opening 20*g* and 20*f*, are fully received within the cavity 32.

Figure 7:
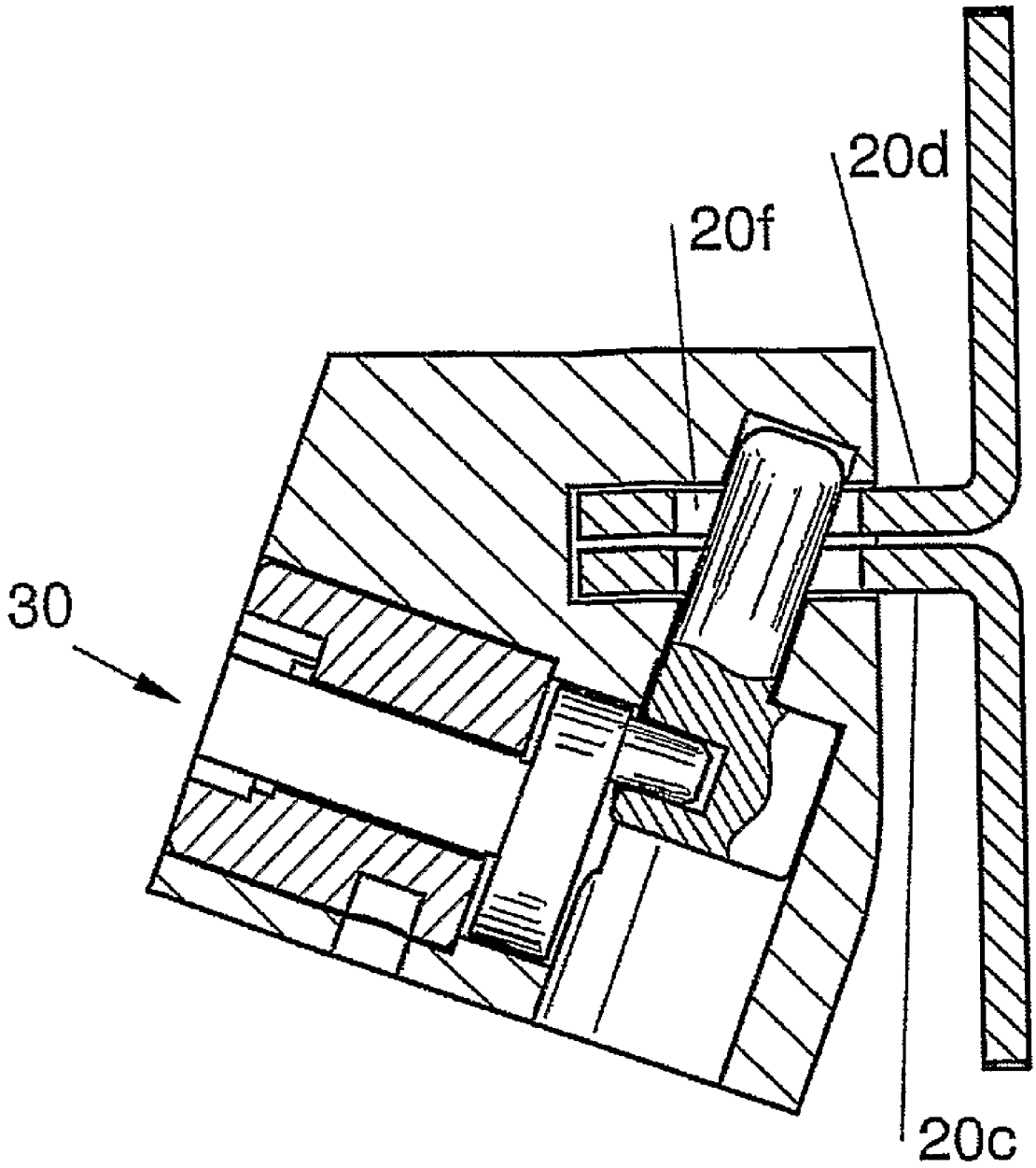
FIG. 7 shows the completion of locking operation.

Then, by turning the key 12 by 180°, the toggle pin 40 drives the block 42 in a sliding linear movement so that the lock pin 44 enters cavity 32, passing through the openings 20*e* and 20*f* of the ears 20*c* and 20*d*, respectively, thereby completing the locking operation, as shown in FIG. 7.

Those skilled in the art, will readily appreciate that the invention has been described hereabove with reference to a specific embodiment. However, this is not the only example and embodiment in which the invention may be practiced. Indeed, various modifications may be made to the above-described example and embodiment without departing from the intended spirit and scope of the present invention, and it is intended that all such modifications be included within the scope of the following claims.

What is claimed is:

1. A locking device for a box-shaped container having a base and a separable cover each provided with an ear-like extension having an opening such that in an overlapping position the openings are in register one with respect to the other and the container is in a locked position when a locking element is inserted through both openings, the locking device comprising:

(a) a block-shaped housing;

(b) a key-operated rotor installed within the housing and having a longitudinal extent along an axial direction, the rotor configured to be turned with a key;

(c) a slidable locking element coupled to the rotor and positioned and configured to slide upon rotation of the rotor by 180° in one rotating direction or in an opposite rotating direction, the locking element configured to slide over a first distance in a first direction or in an opposite direction, the first direction and the opposite direction being normal to the axial direction of the rotor; and (d) a cavity formed in the housing and configured to accommodate therein both said ear-like extensions when in the overlapping position, wherein the locking element is configured to be driven in the direction of and across said cavity and openings to slide the locking element to the locked position, and the locking element is configured to be driven in the opposite direction out of the said cavity to slide the locking element to an open position, wherein each of the ear-like extensions is formed with a second opening, the second openings being in register one with respect to the other when in the overlapping position, the second openings configured to receive a bolt inserted therethrough, and in the locking device said cavity is configured to receive therein the inserted bolt.

2. The device as claimed in claim 1, further comprising;

a reciprocable block; and a toggle pin slidably received in a slot formed in the reciprocable block, wherein the key-operated rotor is coupled to the locking element via the toggle pin.

3. The device as claimed in claim 2 further comprising a security cable attachable to the housing by one end thereof whereas the other end of the security cable is adapted to be looped around a stationary object.

4. The device as claimed in claim 3, wherein the housing includes a side-wall including a groove, and wherein said one end of the cable comprises a cable-head configured to be inserted into the groove formed at the side-wall so as to be self-arrested so as to prevent removal of the cable-head from the housing in a mounted position of the housing.

5. The device as claimed in claim 1, further comprising the bolt.

* * * * *